US005335986A

United States Patent [19]

Hartrum et al.

[11] Patent Number: 5,335,986

[45] Date of Patent: Aug. 9, 1994

[54] INTERLOCK ASSEMBLY

[75] Inventors: Laude E. Hartrum, Pentwater; Raymond J. Smuda, Manistee, both of Mich.

[73] Assignee: Metalworks, Inc., Ludington, Mich.

[21] Appl. No.: 2,064

[22] Filed: Jan. 8, 1993

[51] Int. Cl.[5] ..... E05C 7/06

[52] U.S. Cl. ..... 312/220; 312/217

[58] Field of Search ..... 312/215, 216, 217, 220–221, 312/222, 107.5; 312/107.5; 49/15; 292/99, 102, 146, 182, 198, 203, 216

[56] References Cited

U.S. PATENT DOCUMENTS

| | | | |
|---|---|---|---|
| 3,900,236 | 8/1975 | Goulish et al. | 312/217 |
| 3,909,090 | 9/1975 | Breckner et al. | 312/217 |
| 4,239,309 | 12/1980 | DeFouw et al. | 312/221 |
| 4,240,685 | 12/1980 | Terlecki | 312/221 X |
| 4,272,138 | 6/1981 | Stark | 312/221 |
| 4,298,236 | 11/1981 | Laroche | 312/215 |
| 4,355,851 | 10/1982 | Slusser | 312/215 |
| 4,480,883 | 1/1984 | Young | 312/220 |
| 4,711,505 | 12/1987 | Lakso | 312/220 |
| 4,732,434 | 3/1988 | Hartrum | 312/221 |
| 4,768,844 | 9/1988 | Ludwig | 312/221 |
| 4,957,334 | 9/1990 | Lakso | 312/221 |
| 4,960,309 | 10/1990 | Scheerhorn | 312/221 |
| 5,056,876 | 10/1991 | Scheerhorn | 312/221 |
| 5,199,774 | 4/1993 | Hedinger et al. | 312/221 X |

*Primary Examiner*—Kenneth J. Dorner
*Assistant Examiner*—Nancy Mulcare
*Attorney, Agent, or Firm*—Ian C. McLeod

[57] ABSTRACT

An interlock assembly (20) for two or more horizontally sliding drawers (11, 13) in a cabinet (10) to prevent opening more than one drawer at a time is described. The interlock assembly is characterized by each drawer having rotating cam members (21, 23) with lobes (21A, 23A) and valleys (21B, 23B) which mate with blocks (25, 27, 29, 31) having corresponding lobes (25A, 27A, 29A, 31A) and valleys (25C, 27C, 29C, 31C). When a first cam member (23) is rotated by opening a drawer (13) the lobes (23A) of the cam member (23) engage lobes (29A, 31A) of the corresponding blocks (29, 31) to move the blocks (25, 27, 29, 31 ) and cam member (23) towards the cabinet (10) to provide the interlock for the drawers so that the other drawer (11) can not be opened. Mating male pins (29D, 31D) extend from the cam blocks (29, 31) along the axis and mates with opposed female openings (23C) in the cam members (23) so that the cam members (23) is rotatably connected to the cam blocks (29, 31) for rotational movement of the cam member (23) around the axis. The cam member (21) and cam blocks ( 25, 27) have a similar mating pin (25D, 27D ) and female opening (21C) rotatable connection. Also, the blocks are provided with extension portions that mount on a guide bracket (45) that helps to keep the interlock assembly mounted along the axis.

34 Claims, 8 Drawing Sheets

INTERLOCK ASSEMBLY

Figure 1:
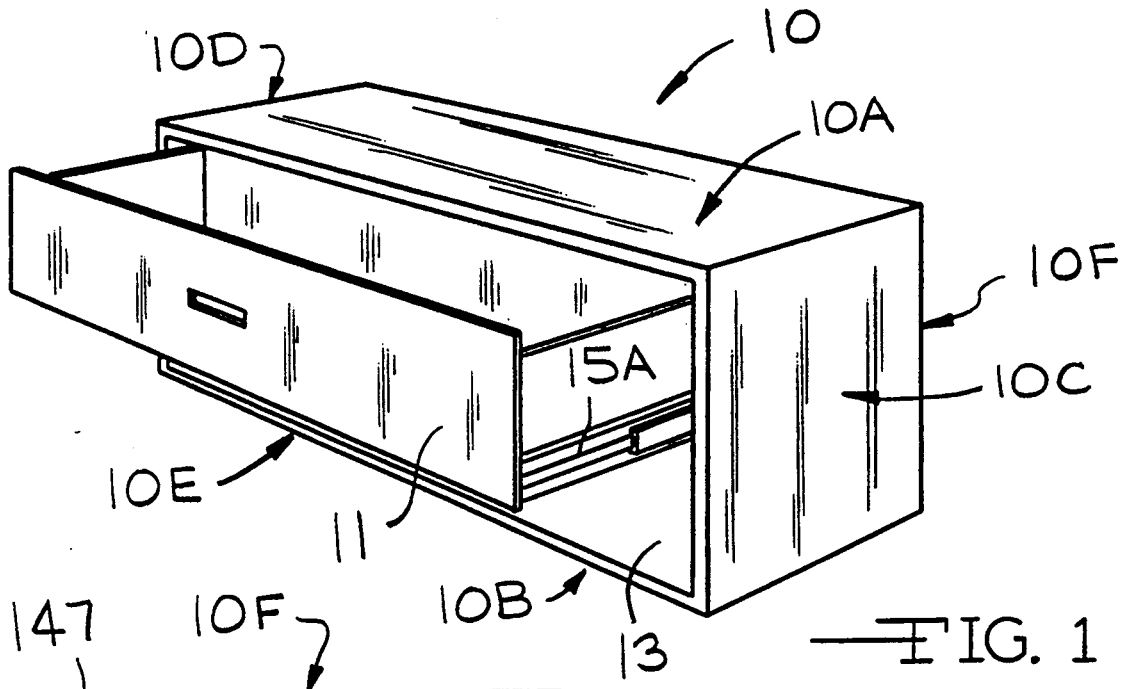

BACKGROUND OF THE INVENTION (1) Field of the Invention

The present invention relates to an improved interlock assembly for preventing more than one drawer in a cabinet from being opened at one time. In particular, the present invention relates to an interlock assembly comprised of a train of drawer interlock units having horizontally rotating cam members with opposed cam surfaces which contact block members having mating cam surfaces. The cam members pivot with respect to the block members around a longitudinal axis of the train of interlock units while a configuration of mating male pins and female openings in the block members and cam member retains the individual interlock units together, along the longitudinal axis. The cam surfaces on the cam members and the block members comprise sinusoidal lobes and valleys that mate together when the interlock assembly is in a rest position when no drawers are open. Opening a first drawer, causes the cam member corresponding to the first drawer to pivot around the axis so that the lobes of the cam member are rotated to seat in indentations in the lobes of the block members. This causes the train of interlock units to move along the longitudinal axis to contact opposed walls in the cabinet, thereby preventing a second drawer from being opened. The block members have tab portions extending from one side of the block members. The block members are mounted in a guide channel that extends the length of the train of interlock units. A portion of the guide channel extends around the tab portion of the block members. The guide channel thus prevents the block members from rotating around the longitudinal axis of the train of interlock units while enabling the block members to move linearly along the longitudinal axis when a cam member is pivoted by opening a drawer. That way, the cabinet is prevented from becoming top heavy and tipping over. The interlock assembly also acts as a safety device by preventing a person bent over a lower drawer from hitting their head on an opened upper drawer.

(2) Prior Art

U.S. Pat. No. 4,480,883 to Young describes an interlock assembly wherein cam elements rotate vertically to raise and lower vertically mounted locking bars provided in a track. The device works well; however, the interlock mechanism is quite expensive to manufacture and assemble. U.S. Pat. No. 4,298,236 to Laroche also describes cam elements which are vertically rotated to move locking bars. This apparatus is more expensive to construct than the present invention.

U.S. Pat. No. 4,732,434 to Hartrum describes an interlock assembly for a cabinet wherein a train of drawer interlock units having horizontally rotating cam members with mating block members corresponding to the drawers in the cabinet slide on a rod mounted between opposed walls in the cabinet. The cam members and block members have sinusoidal surfaces with lobes and valleys that mate when the drawers are closed. When a first drawer is opened, the corresponding cam member is rotated on the rod to cause the lobes to seat in indentations in the lobes of the block members. This causes the block members of the rotated cam member and the remaining units of block and cam members to move on the rod to contact the opposed walls in the cabinet so that a second drawer can not be opened. This device works well; however, there is a need for an improved interlock assembly that is less difficult and expensive to construct and which is easily retrofitted to existing file cabinets.

Other prior art believed to be less pertinent is described in U.S. Pat. Nos. 4,355,851 to Slusser and 3,909,090 to Breckner et al.

OBJECTS

It is therefore an object of the present invention to provide an interlock assembly for a cabinet with sliding drawers which prevents more than one drawer from being opened at one time. Further, it is an object of the present invention to provide an interlock assembly which is easily retrofitted to existing cabinets to prevent more than one drawer in the cabinet from being opened at one time. Further, it is an object of the present invention to provide a drawer interlock assembly comprised of units of mating cam and block members wherein the cam members pivot with respect to the block members along a longitudinal axis of the interlock assembly using a mating male pin and female opening configuration for the block members and the cam members and which provides long and reliable service for the units. Still further, it is an object of the present invention to provide a drawer interlock assembly wherein the block members of the assembly have tab portions extending from one side of the block members which are mounted in a guide channel extending the length of the interlock assembly with a portion of the guide channel extending around the tab portion of the block members so that the block members are able to move linearly along the longitudinal axis of the interlock assembly but are prevented from rotating around the axis when a drawer is opened. Finally, it is an object of the present invention to provide a drawer interlock assembly which is inexpensive to manufacture and easily assembled into cabinets to prevent opening more than one drawer at one time. These and other objects will become increasingly apparent by reference to the following descriptions and to the drawings.

IN THE DRAWINGS

FIG. 1 is a perspective view of a cabinet 10 with two horizontally sliding drawers 11 and 13 which can utilize the interlock assembly of the present invention wherein one drawer 11 is open.

Figure 2:
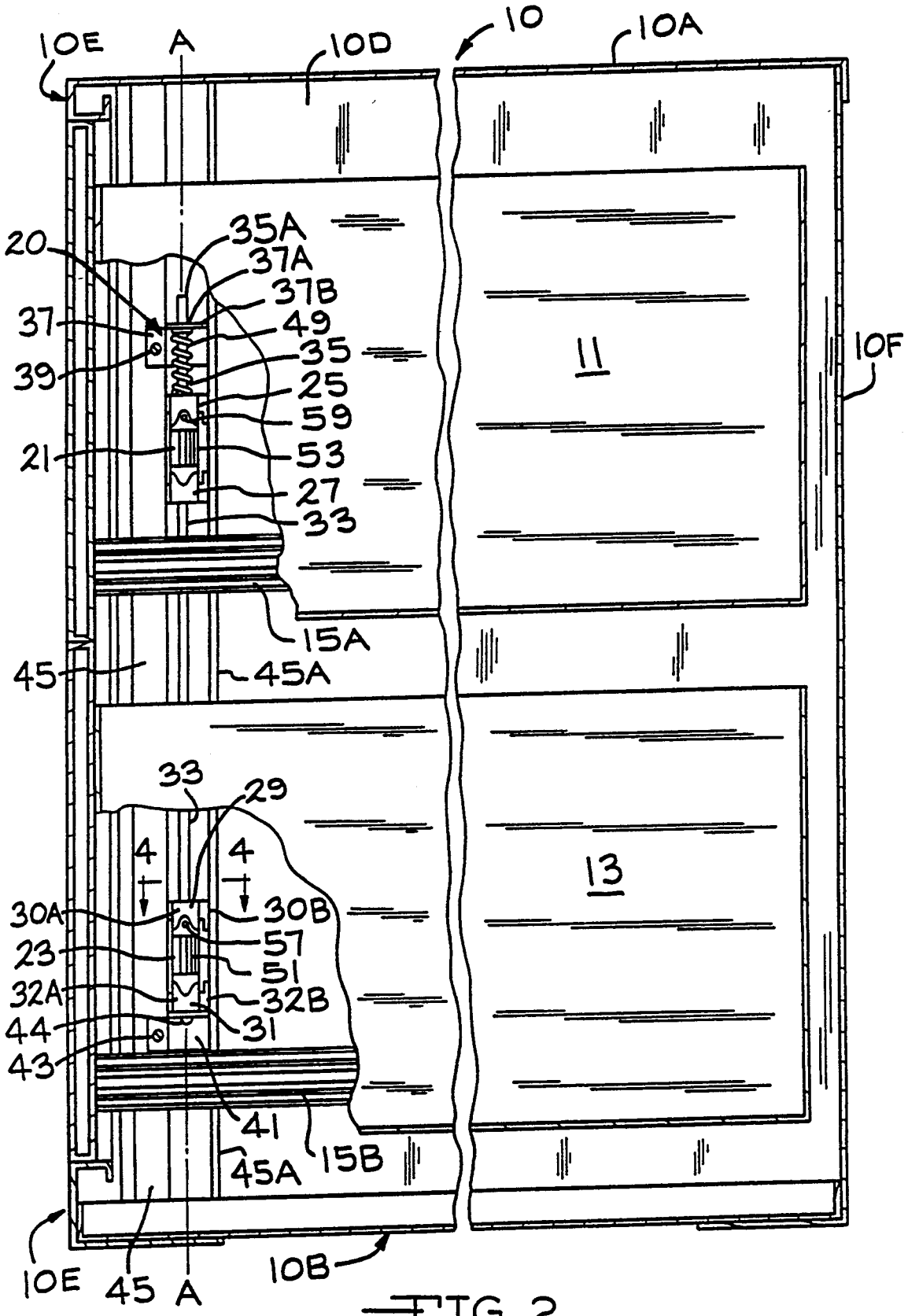

FIG. 2 is a side, partially cut away view of the cabinet 10 shown in FIG. 1 particularly showing the two horizontally sliding drawers 11 and 13 in a closed drawer position and with the interlock assembly 20 mounted adjacent to a sidewall 10D of the cabinet 10 in a rest position so that either drawer 11 or 13 can be opened.

Figure 3:
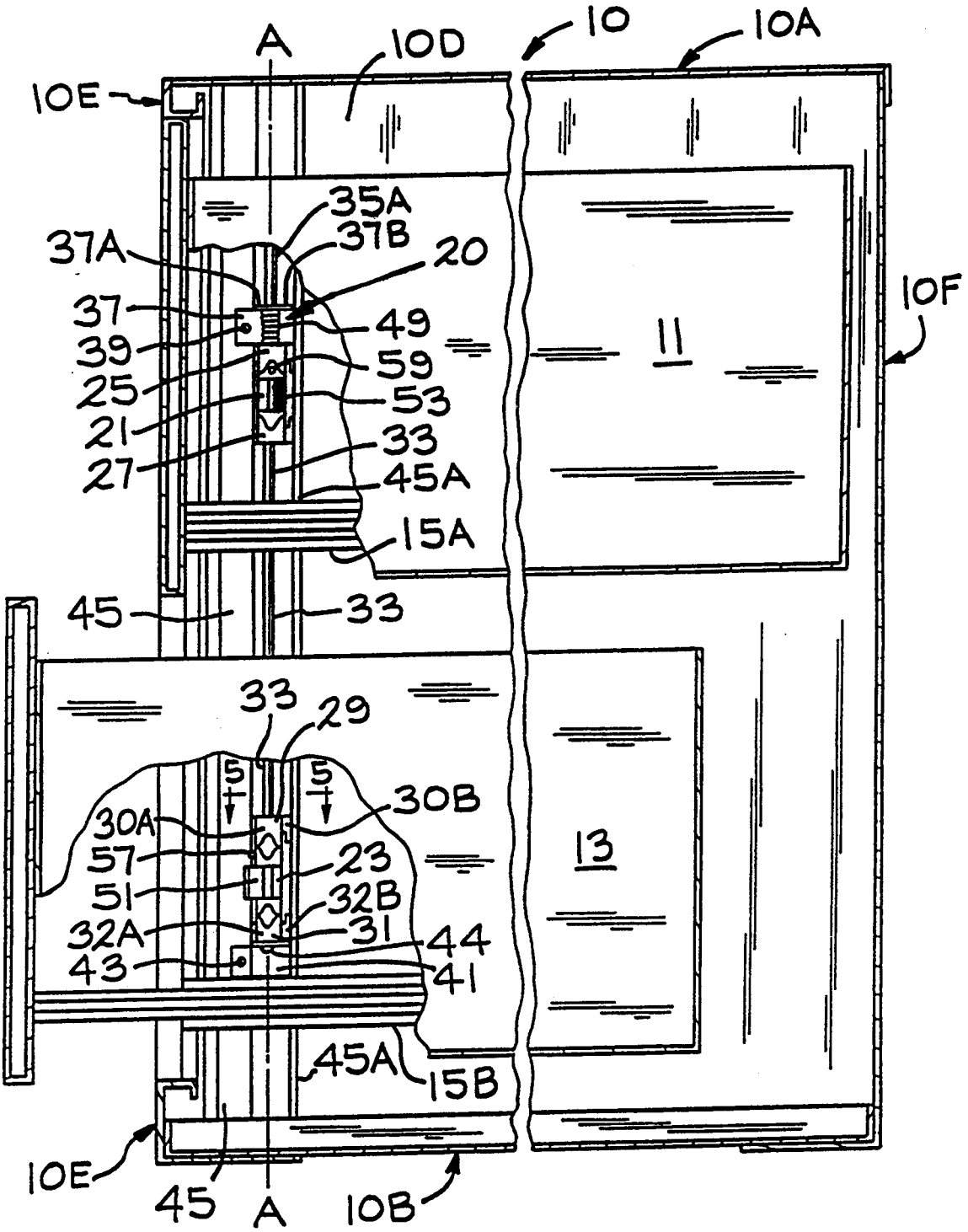

FIG. 3 is a side, partially cut away view of the cabinet 10 shown in FIG. 1 wherein one of the drawers 13 is open thereby actuating the interlock assembly 20 to prevent the other drawer 11 from being opened.

Figure 4:
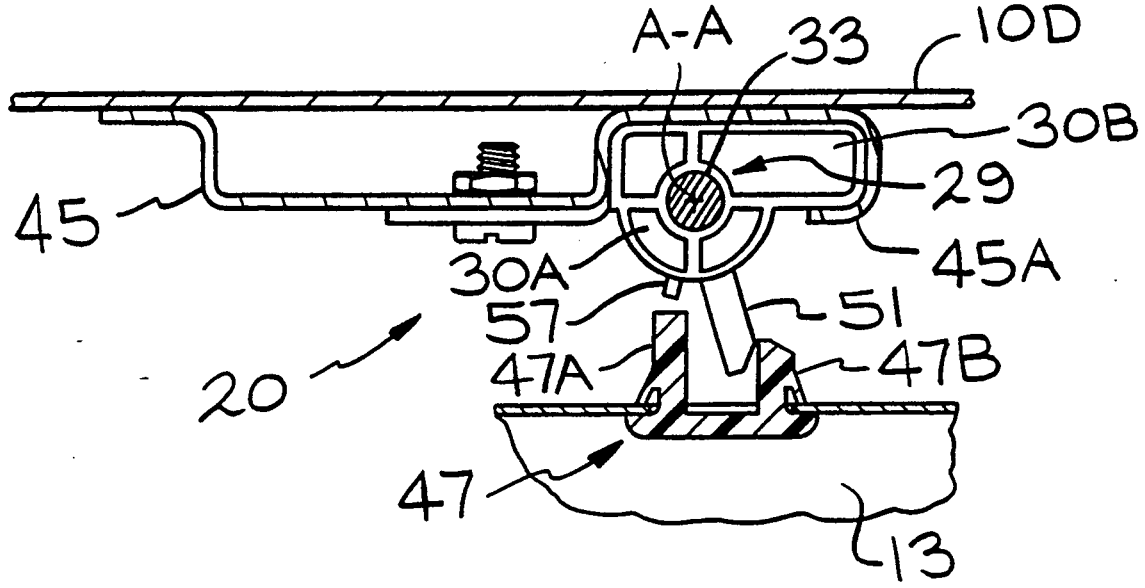

FIG. 4 is a plan partial sectional view along line 4—4 of FIG. 2 showing the interlock assembly 20 with the drawer 13 closed.

Figure 5:
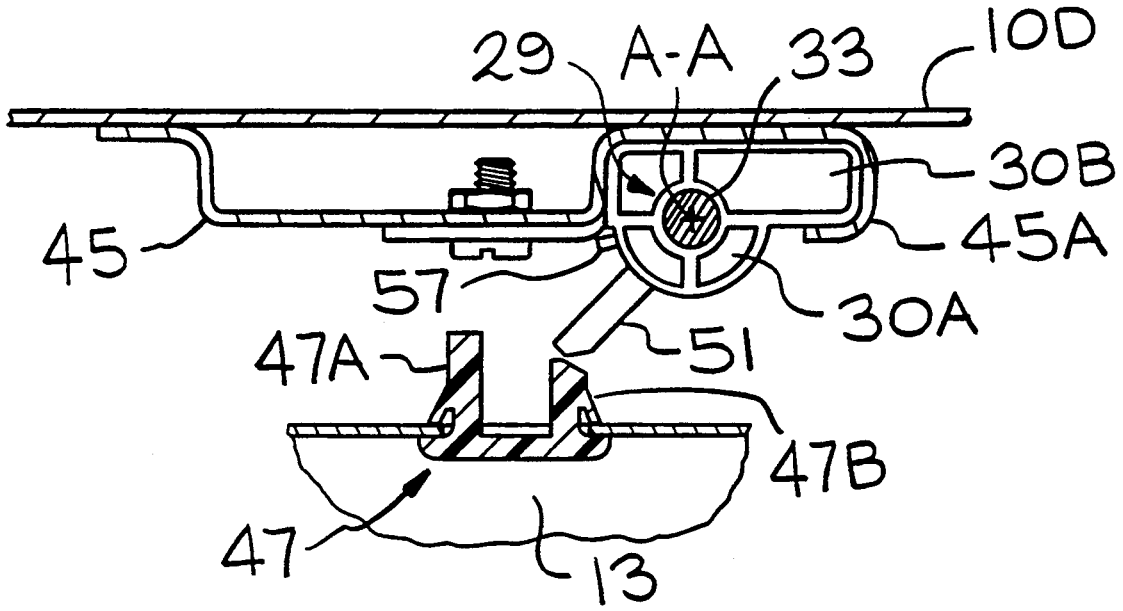

FIG. 5 is a plan partial sectional view along line 5—5 of FIG. 3 showing the actuated interlock assembly 20 on drawer 13 that prevents the upper drawer 11 from being opened.

Figure 6:
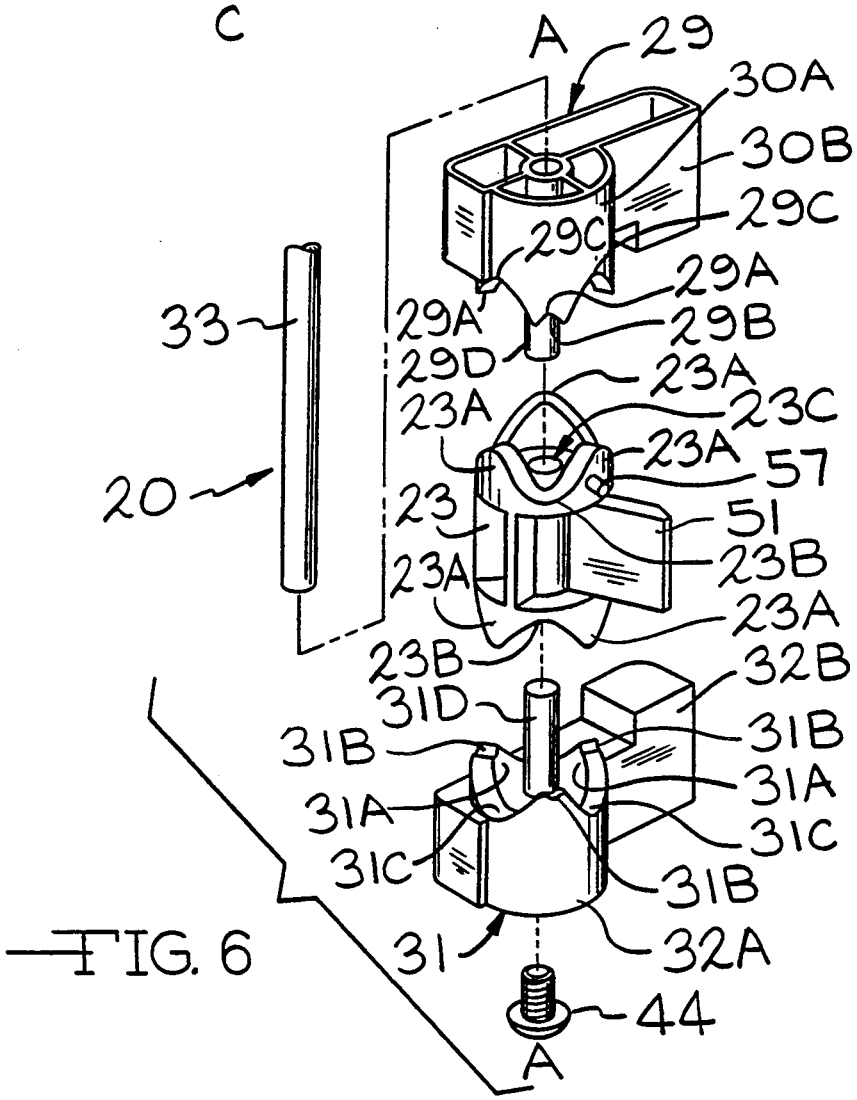

FIG. 6 is an exploded view of a portion of the interlock assembly 20 wherein cam member 23 can be rotated to raise block member 29 and thus the upper block members 25 and 27 and cam member 21 shown in FIG. 2.

Figure 7:
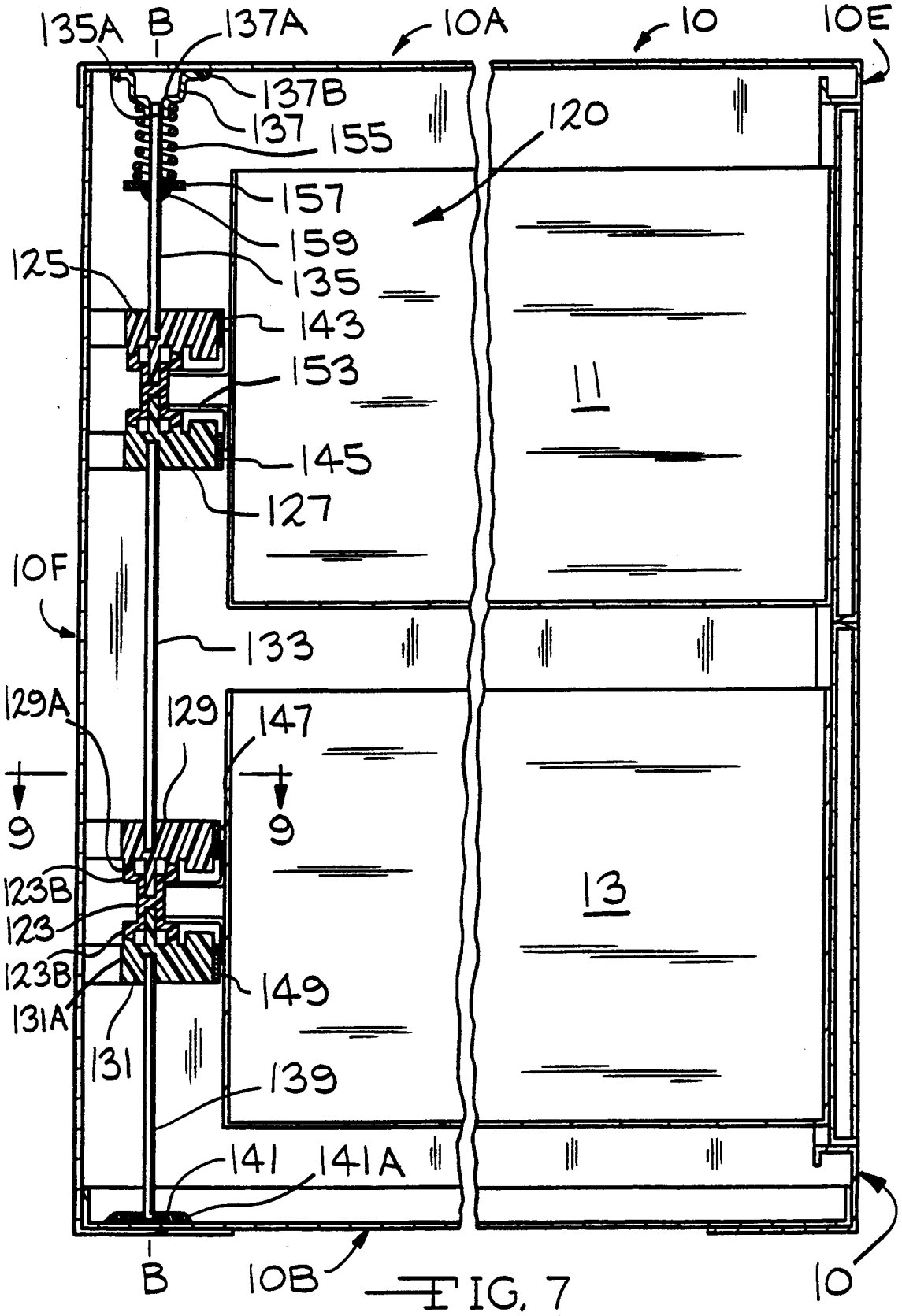

FIG. 7 is a side cross-sectional view of the cabinet 10 shown in FIG. 1 particularly showing the two horizontally sliding drawers 11 and 13 in a closed drawer position and with an interlock assembly 120 mounted adjacent to a back wall 10F of the cabinet 10 in a rest position so that either drawer 11 or 13 can be opened.

Figure 8:
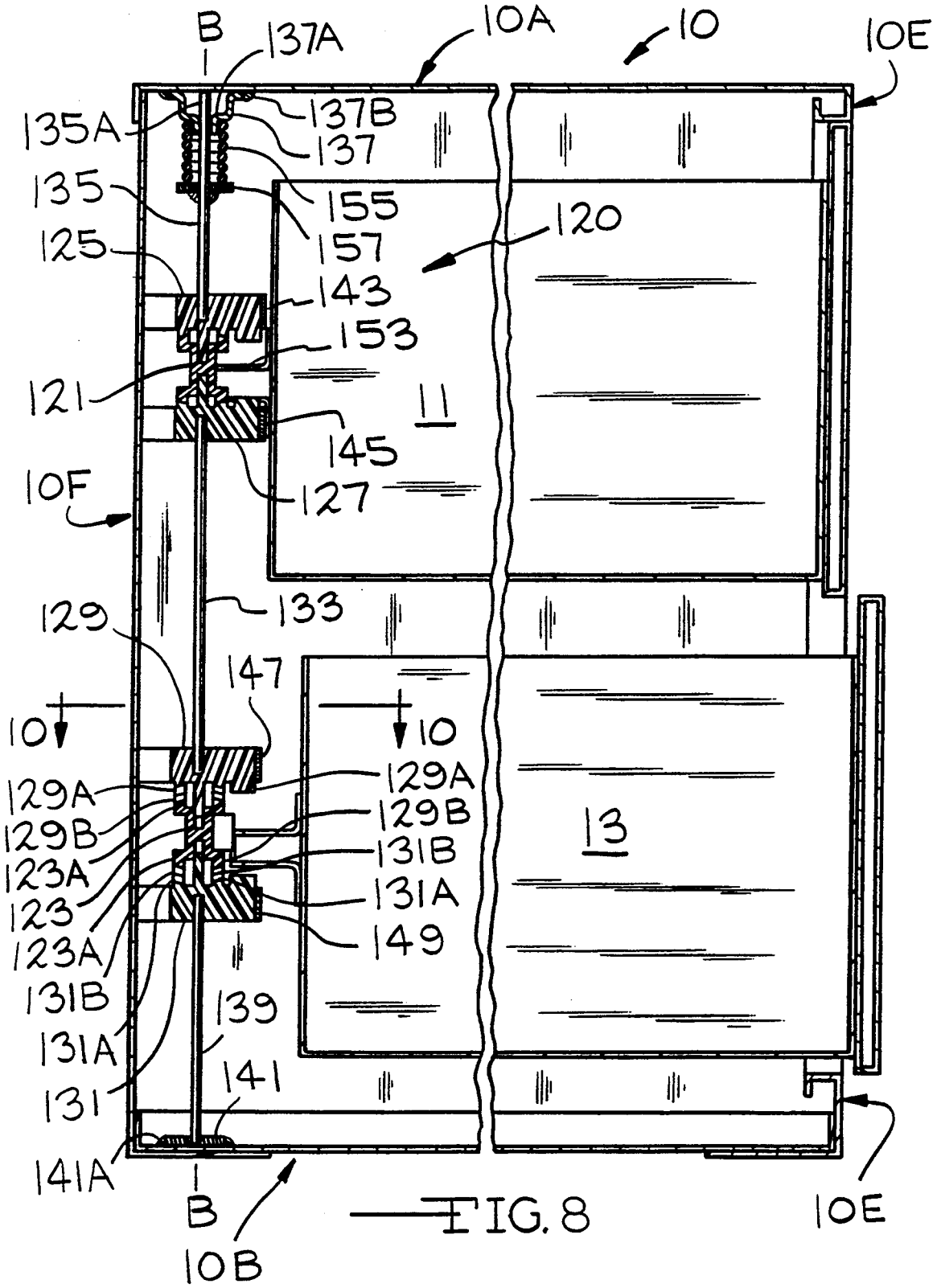

FIG. 8 is a side cross-sectional view of the cabinet 10 shown in FIG. 1 wherein one of the drawers 13 is open thereby actuating the interlock assembly 120 to prevent the other drawer 11 from being opened.

Figure 9:
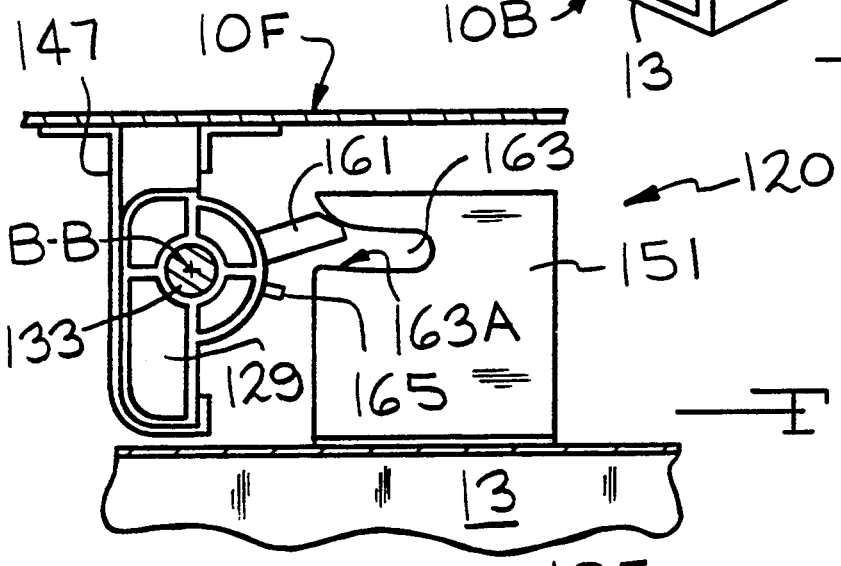

FIG. 9 is a plan partial sectional view along line 9—9 of FIG. 7 showing the interlock assembly 120 with drawer 13 closed.

Figure 10:
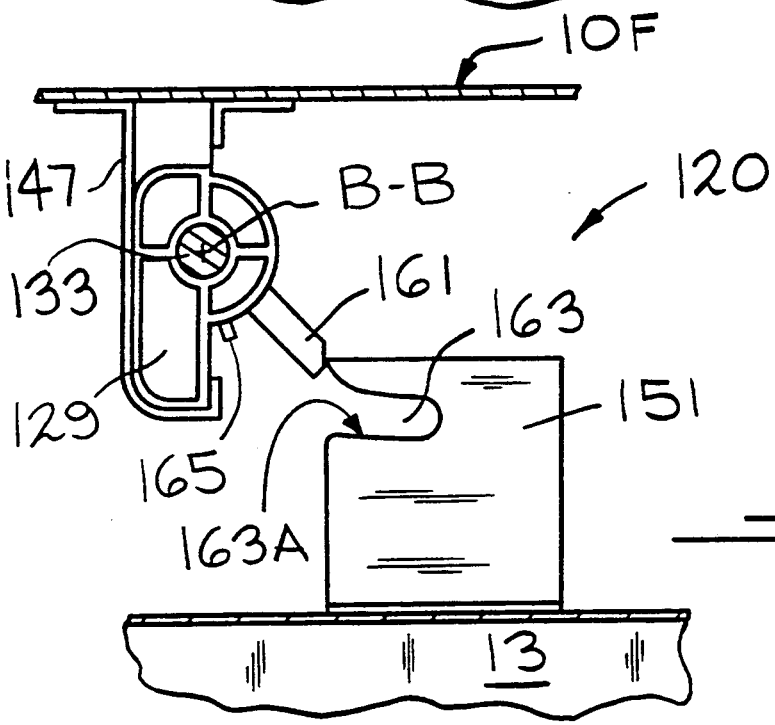

FIG. 10 is a plan partial sectional view along line 10—10 of FIG. 8 showing the actuated interlock assembly 120 on drawer 13 which prevents the upper drawer 11 from being opened.

Figure 11:
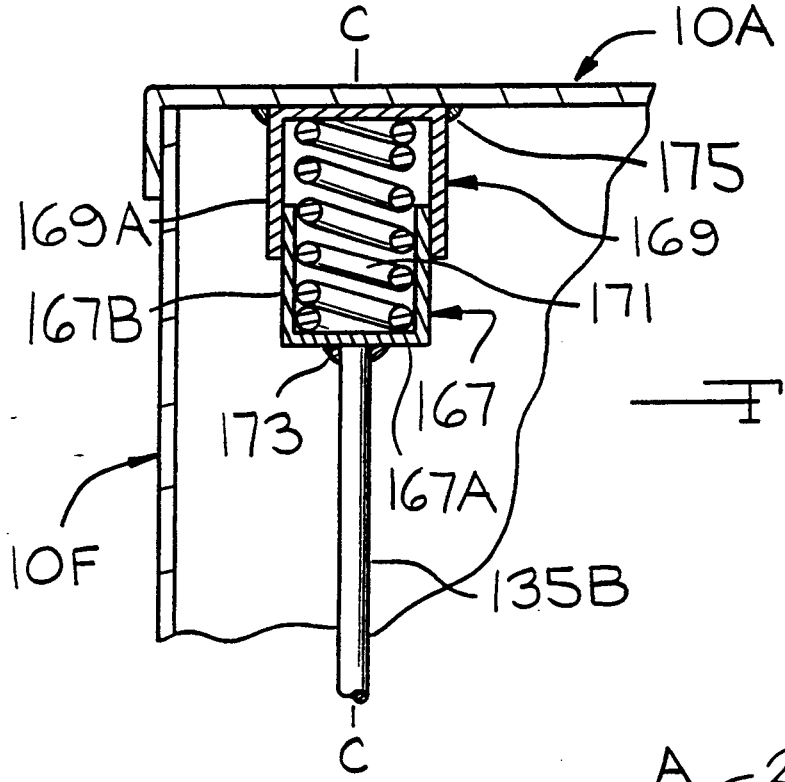

FIG. 11 is a cross-sectional view of an engagement means for the interlock assembly 120 including a first cup member 167 mopunted on a rod 135B and held along the longitudinal axis C—C by a second cup member 169 to engage the upper wall 10A of the cabinet 10 shown in FIG. 1 when one of the drawers 11 or 13 is open to actuate the interlock assembly 120.

Figure 12:
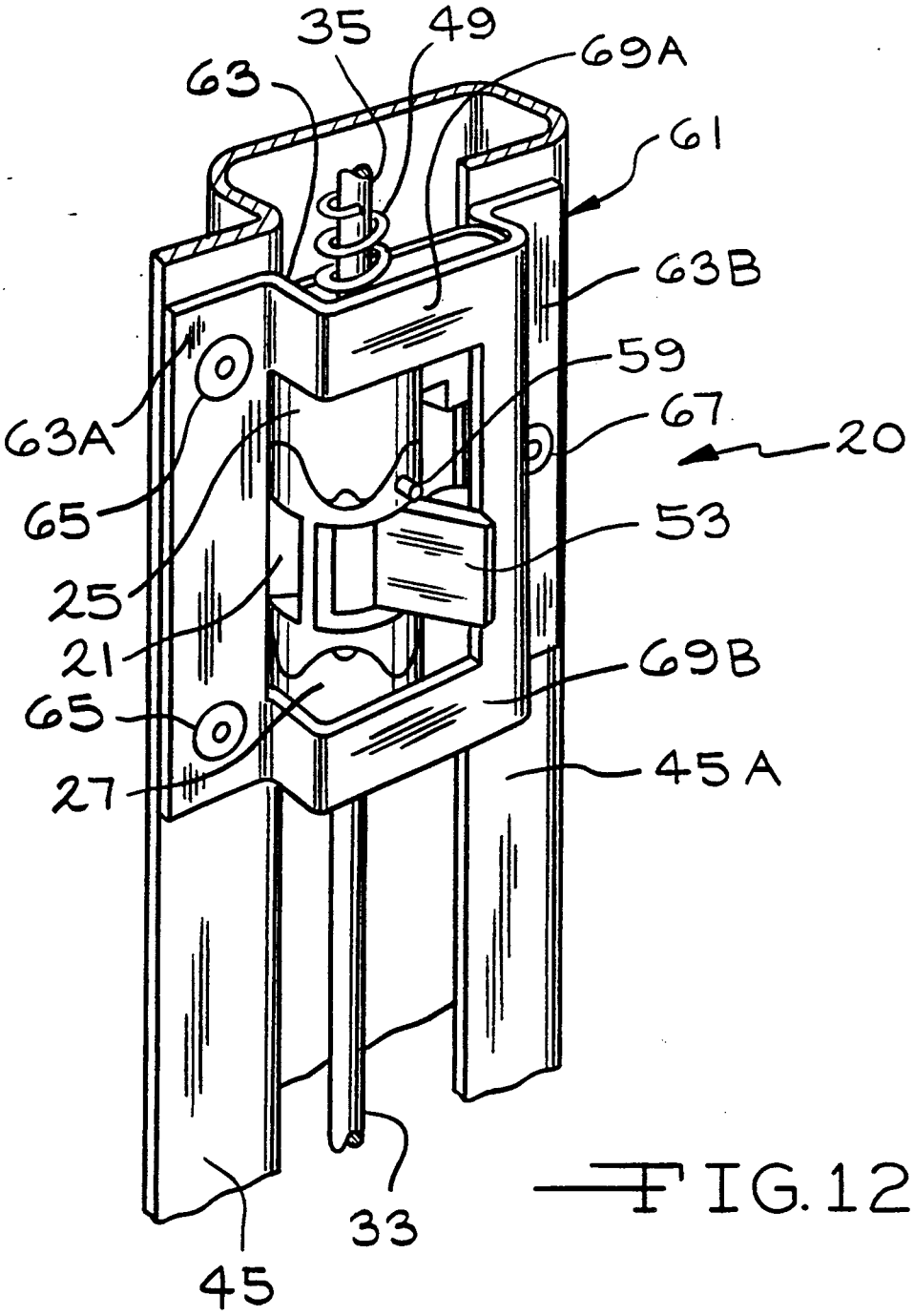

FIG. 12 is a perspective view of a cage 61 that mounts on the guide bracket 45 and helps to hold the cam blocks 25 and 27 along the axis A—A when the drawer 11 is opened.

GENERAL DESCRIPTION

The present invention relates to a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back wall to close the drawer and an interlock assembly mounted inside of and on the housing which engages an arm means from the drawer to prevent both drawers from being opened simultaneously, the improvement in the interlock assembly which comprises: cam means rotatably mounted around a longitudinal axis of the cam means and adjacent to each of the drawers, wherein the cam means have opposed ends along the axis with at least one of the ends of each of the cam means having a sinusoidal surface around the axis such that there are lobes of the sinusoidal surface and valleys between the lobes on the sinusoidal surface on each cam means; block means mounted on the cam means along the axis and mating with the cam means at the one end of each of the cam means having the sinusoidal surface, the block means having mating ends comprising second sinusoidal surfaces with lobes and valleys offset around the end of the block means when the drawers are closed so that the lobes and the valleys of the cam means and the block means mate together, wherein a pin means is mounted between the cam means and the block means which allows for movement of the cam means relative to the block means along and around the longitudinal axis; pivot means mounted on a side between the ends of each cam means, which engage the arm means for each drawer; rigid connection means mounted along the longitudinal axis and mounted on and extending between block means for adjacent drawers and mounted on and extending between block means and the housing; and guide means mounted inside the housing and supporting the block means for linear movement along the axis without rotational movement around the axis upon rotation of the cam means by the pivot means and by the arm means, wherein the guide means supports the interlock assembly to prevent movement of the connection means, cam means and block means perpendicular to the longitudinal axis and wherein when one of the cam means is rotated around the longitudinal axis on the pin means relative to the block means by the pivot means and by the arm means of a first one of the drawers, the lobes of the one cam means and the block means of the first drawer are engaged which causes the block means and the cam means to rotate on the pin means and to move along the longitudinal axis with the connection means so that the interlock assembly moves towards an abutment means on the housing so that a second cam means is prevented from being rotated by the pivot means and by the arm means of a second one of the drawers to prevent the second drawer from being opened.

Further, the present invention relates to a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back wall to close the drawer and an interlock assembly mounted inside of and on the housing which engages an arm means from the drawer to prevent both drawers from being opened simultaneously, the improvement in the interlock assembly which comprises: cam means rotatably mounted around a longitudinal axis of the cam means and adjacent to each of the drawers wherein opposite ends of the cam means have a sinusoidal surface around the axis such that there are lobes of the sinusoidal surface and valleys between the lobes on the surface at each end of each cam means; block means mounted on the cam means along the axis and mating with the cam means at each of the ends of each cam means, the block means having ends with second sinusoidal surfaces with lobes and valleys offset around the ends of the block means so that when the drawers are closed, the lobes and valleys of the cam means and the block means mate together, wherein a pin means is mounted between the cam means and the block means which allows for movement of the cam means relative to the block means along and around the longitudinal axis; pivot means mounted on a side between the ends of each cam means which engage the arm means for each drawer; rigid connection means mounted along the longitudinal axis and mounted on and extending between block means for adjacent drawers and mounted on and extending between block means and the housing; and guide means mounted inside the housing and supporting the block means for linear movement along the axis without rotational movement around the axis upon rotation of one of the cam means by the pivot means and by the arm means, wherein the guide means supports the interlock assembly to prevent movement of the connection means, cam means and block means perpendicular to the longitudinal axis and wherein when one of the cam means is rotated around the longitudinal axis on the pin means relative to the block means by the pivot means and by the arm means of a first one of the drawers, the lobes of the one cam means and the block means of the first drawer are engaged which causes the block means and the cam means to rotate on the pin means and to move along the longitudinal axis with the connection means, so that a stop means portion of the interlock assembly prevents a second cam means from being rotated by the pivot means and by the arm means of a second one of the drawers to prevent the second drawer from being opened.

Finally, the present invention relates to a cabinet including a housing having a top wall and opposed bottom wall, two opposed sidewalls, a front wall and back wall, at least two drawers mounted inside the housing through the front wall so as to slide horizontally away from the front wall to open the drawer and towards the back wall to close the drawer and an interlock assembly mounted inside of and on the housing which engages an arm means from the drawer to prevent both drawers from being opened simultaneously, the improvement in the interlock assembly which comprises: cam means rotatably mounted around a longitudinal axis of the cam means and adjacent to each of the drawers, wherein opposite ends of the cam means have a sinusoidal surface around the axis such that there are lobes of the sinusoidal surface and valleys between the lobes on the surface at each end of each cam means; block means mounted on the cam means along the axis and mating with the cam means at each of the ends of each cam means, the block means having ends with second sinusoidal surfaces with lobes and valleys offset around the ends of the block means so that when the drawers are closed, the lobes and valleys of the cam means and the block means mate together, wherein the block means have at least one tab means extending from at least one side of the block means; pivot means mounted on a side between the ends of each cam means which engage the arm means for each drawer; rigid connection means mounted along the longitudinal axis and mounted on and extending between block means for adjacent drawers and mounted on and extending between block means and the housing; and guide means mounted inside the housing and supporting the block means for linear movement along the longitudinal axis without rotational movement around the axis upon rotation of one of the cam means by the pivot means and by the arm means, wherein a portion of the guide means is mounted on the tab means of the block means so that the guide means supports the interlock assembly to prevent movement of the connection means, cam means and block means perpendicular to the longitudinal axis and wherein when one of the cam means is rotated around the axis by the pivot means and by the arm means of a first one of the drawers, the lobes of the one cam means and the block means of the first drawer are engaged which causes the block means, the cam means and the connection means of the interlock assembly to move linearly along the guide means along the axis so that a stop means portion of the interlock assembly prevents a second cam means from being rotated by the pivot means and by the arm means of a second one of the drawers to prevent the second drawer from being opened.

The block means and cam means with the connection means form the interlock assembly and are slideably mounted on the guide means for movement along the axis of the interlock assembly so that a stop means portion of the assembly moves towards an abutment means on the housing by means of rotation of one cam means by an arm means engaging a pivot means on the cam means. The result is that a second cam means is prevented from rotation by a second arm means engaging a second pivot means since the interlock assembly cannot move any further along the longitudinal axis. The mating male and female pins and opening configuration keep the cam means mated to the block means. As will be seen, the interlock assembly is very inexpensive to construct and assemble and provides safe, trouble free service.

SPECIFIC DESCRIPTION

FIG. 1 shows a file cabinet 10 providing a housing for two drawers 11 and 13 which slide in and out on sliders 15 (one shown). The drawers 11 and 13 slide in and out on sliders 15A and 15B (FIGS. 2 and 3) mounted in the cabinet 10 on each side of the drawers 11 and 13. The cabinet 10 includes a top wall 10A, bottom wall 10B, opposed sidewalls 10C and 10D, front wall 10E and back wall 10F which serve as reference points in the following description. As shown in FIG. 3, drawers 11 and 13 open to the front of the casket and are otherwise conventionally constructed as is the cabinet 10.

A vertically oriented interlock assembly 20 is shown in position along the axis A—A in the cabinet 10 in FIGS. 2 and 3. The interlock assembly 20 is preferably mounted on the sidewall 10D, and as shown is adjacent the front wall 10E of the cabinet 10. The interlock assembly 20 can also be mounted on the sidewall 10D, adjacent the back wall 10F (not shown), which is preferred. The exact position of the interlock assembly 20 on the sidewall 10D is not critical to practice the full scope of the present invention.

For the two drawers 11 and 13 of cabinet 10, the interlock assembly 20 is comprised of vertically slideable and horizontally rotatable cam members 21 and 23 and cam blocks 25, 27, 29 and 31 mounted on either side of and in contact with the cam members 21 and 23 along the axis A—A. The interlock assembly 20 consists of cam member 21 with block members 25 and 27 which constitute a first interlock unit for drawer 11 and cam member 23 with block members 29 and 31 which constitute a second interlock unit corresponding to drawer 13. The number of interlock units is dictated by the number of drawers in the cabinet 10.

Rod member 33 is vertically oriented along the axis A—A between the cam blocks 27 and 29. A second rod member 35 extends vertically upwards along the axis A—A from the block 25 with an upper end 35A extending through an opening 37A in a horizontal portion 37B of a bracket 37 as an abutment portion of the cabinet 10, spaced from the top wall 10A of the cabinet 10, as shown in FIG. 2. Bracket 37 is mounted to the sidewall 10D by screw 39. Block member 31 is mounted on a bracket 41 as an abutment portion of the cabinet 10 mounted to the sidewall 10D, adjacent the bottom wall 10B by screw 43. The block member 31 is held along the longitudinal axis A—A by a pin 44 (partially shown in phantom in FIGS. 2 and 3) extending through the bracket 41 and into the block 31. Also, the block member 31 itself can be securely mounted to the bottom wall 10B of the cabinet 10, thus eliminating the bracket 41. Although screws 39 and 43 are shown, it should be understood that any suitable securing means is contemplated by the scope of the present invention.

The cam blocks 25, 27, 29 and 31 are secured to the sidewall 10D of the cabinet 10 by means of a guide bracket 45 that extends substantially the length of the sidewall 10D. Although the guide bracket 45 is shown secured to the sidewall 100 in FIG. 4, it is preferred that the guide bracket 45 be an integral part of the sidewall 10D. As shown in FIGS. 4 to 6, block member 29 is comprised of a cam portion 30A and an extension portion 30B. Similarly, block member 31 is comprised of cam portions 32A and an extension portion 32B. The block members 29 and 31 are representative of the block members 25 and 27. A hooked portion 45A, of the guide bracket 45, extends around the extension portion 30B of the block member 29. The hooked portion 45A prevents the block member 29 from rotating around the axis A—A while providing for sliding, linear movement of the block member 29 up and down along the axis A—A. Guide bracket 45 cooperates with the other block members 25, 27 and 31 in a similar manner except that block member 31 does not slide along the axis A—A. Extending through an opening in the side of drawer 13 is an extension 47 having arms 47A and 47B that cooperate with the cam member 23 as hereinafter described in detail. Drawer 11 has a similar extension (not shown) which cooperates with cam member 21 in a similar manner as extension 47 cooperates with cam member 23.

A spring 49 is mounted around the rod member 35 and extends between the bracket 37 and the block member 25. The opening 37A in bracket 37 is in a slideable relationship with the rod member 35. Spring 49 urges the rod member 33, cam blocks 25, 27 and 29 and cam members 21 and 23 downward to urge the interlock assembly 20 into a closed drawer position (FIG. 2). The block member 25 moves towards the horizontal portion 37B of bracket 37 as a stop means for the interlock assembly 20 when a drawer 11 or 13 is opened, as shown in FIG. 3. However, the block member 25 need not engage the bracket 37 when a drawer 11 or 13 is open. What is important is that the block member 25 is in a closely spaced relationship with the bracket 37 when a first drawer 11 or 13 is open so that there is insufficient space between the block member 25 and the bracket 37 to open a second drawer 11 or 13.

FIGS. 4 to 5 show a pivot member 51 of cam member 23 which is rotated clockwise by arm 47B of extension member 47 by pulling drawer 13 open (FIG. 5) to engage the interlock assembly 20, as will hereinafter be described in detail. When the drawer 13 is moved into a closed position, arm 47A of extension 47 rotates the pivot member 51 counterclockwise to disengage the interlock assembly 20, as will hereinafter be described in detail. Cam member 21 has a similar pivot member 53 that is rotated clockwise and counterclockwise by the extension (not shown) of drawer 11 when drawer 11 is moved open and closed.

As particularly shown in FIG. 6, cam blocks 29 and 31 have lobes 29A and 31A with indentations 29B and 31B and valleys 29C and 31C between the lobes 29A and 31A, respectively, in a sinusoidal configuration, phased 120° around the axis A—A Both ends of cam member 23 have lobes 23A and valleys 23B in a sinusoidal configuration, phased 120° around the axis A—A. The cam blocks 25 and 27 and cam member 21 are constructed similarly to cam blocks 29 and 31 and cam member 23. In the closed drawer position (FIG. 2), the lobes 23A of cam 23 are in valleys 29C and 31C of cam blocks 29 and 31 and the lobes 29A and 31A of cam blocks 29 and 31 are in valleys 23B of cam member 23 and are about 60° offset around the axis A—A. Pins 29D and 31D extend from the cam blocks 29 and 31 along the axis A—A and mate with opening 23C in cam member 23. That way, the cam member 23 and cam blocks 29 and 31 are held together along the axis A—A as a train when the cam member 23 rotates around the axis A—A when drawer 13 is opened or closed.

As can be seen in FIGS. 3 to 5, cam member 23 is rotated when arm 47B of extension 47 engages pivot member 51, as drawer 13 is moved into the open position. This causes the cam member 23 to rotate in an arc of 60° perpendicular to the axis A—A. Rotating cam member 23 causes the lobes 23A to engage indentations 29B and 31B of lobes 29A and 31A on cam blocks 29 and 31. This causes the train of blocks 25, 27 and 29, the rod members 33 and 35 and cam member 21 to move in an upward direction so that cam block 25 is in a closely spaced relationship with the horizontal portion 37B of bracket 37 to provide a stop. Spring 49 is compressed by the upward movement of the train. When the cam member 23 is rotated about the axis A—A, a stop tip 57 extending from the cam member 23, adjacent to the pivot member 51 is moved adjacent to the guide bracket 45. The stop tip 57 prevents the cam member 23 from rotating too far around the axis A—A. A similar stop tip 59, serving a similar purpose, is provided on cam member 21.

When the drawer 13 is moved to a closed position, cam member 23 is rotated when pivot member 51 is contacted by arm 47A of extension member 47 of drawer 13. As this happens, spring 49 urges the train of the interlock assembly 20 downward along the axis A—A so that the lobes 23A of cam member 23 are in the valleys 29C and 31C of block members 29 and 31 and the lobes 29A and 31A of block members 29 and 31 are in the valleys 23B of cam member 23, thus allowing another drawer 11 or the same drawer 13 to be opened.

It will be appreciated that the rod members 33 and 35 with the cam members 21 and 23, and the block members 25, 27, 29 and 31 can be positioned as a train at an angle to the vertical between the drawers 11 and 13 where the drawers 11 and 13 are positioned one above the other. The file drawers 11 and 13 can also be side-by-side rather than one above the other with the interlock assembly 20 in a horizontal position. However, the vertical positioning is preferred for ease of installation and operation of the interlock assembly 20. The rod 35 with the bracket 37 and the spring 49 can also be at the bottom wall 10B or one of the sidewalls 10C or 10D of the cabinet 10. The cam members 21 and 23 and block members 25, 27, 29 and 31 are preferably made of a rigid, plastic material such as nylon or acetyl resin.

As shown in FIG. 12, the interlock assembly 20 can also be provided with a cage 61 that serves to help hold the cam blocks 25 and 27 in the guide bracket 45 when the cam member 21 is rotated. The cage 61 is formed of a plate 63 having a left side 63A secured to the guide bracket 45 by rivets 65 and a right side 63B secured to the hooked portion 45 by rivet 67. Although rivets 65 and 67 are shown, any sort of fastening means can be used to secure the cage 61 to the bracket 45. Upper and lower strap portions 69A and 69B of the cage 61, extend between the sides 63A and 63B and extend outwardly to mount over and around the respective cam blocks 25 and 27. There is a slight clearance between the strap portions 69A and 69B and the cam blocks 25 and 27 to provide for movement of the cam blocks 25 and 27 along the axis A—A when the drawer 11 opens.

FIGS. 7 to 10 show another preferred embodiment of a vertically oriented interlock assembly 120 mounted in position along the axis B—B in the cabinet 10. The interlock assembly 120 is preferably positioned adjacent the back wall 10F, about midway between sidewalls 10C and 10D of the cabinet 10. For the two drawers 11 and 13 of cabinet 10, the interlock assembly 120 is comprised of vertically slideable and horizontally rotatable cam members 121 and 123, similar to cam members 21 and 23, and cam blocks 125,127, 129 and 131, similar to cam blocks 25, 27, 29 and 31, mounted on either side of and in contact with cam members 121 and 123 along the axis B—B. The Interlock . assembly 120 consists of cam member 121 with block members 125 and 127 which constitute a first interlock unit for drawer 11 and cam member 123 with block members 129 and 131 which constitutes a second interlock unit corresponding to drawer 13. The number of interlock units is dictated by the number of drawers in the cabinet 10.

Rod member 133 is vertically oriented along the axis B—B between the cam blocks 127 and 129. A second rod member 135 extends vertically upwards along the axis B—B from the block 125 with an upper end 135A extending through an opening 137A in a mounting cup or journal 137, spaced from the top wall 10A of the cabinet 10, as shown in FIG. 7. Mounting cup 137 is mounted to the upper wall 10A by weld 137B. A third vertically oriented rod member 139 is mounted along the axis B—B between the block member 131 and a mounting plate 141. Plate 141 is mounted to the bottom wall 10B by weld 141A. Also, the block member 131 itself can be securely mounted to the bottom wall 10B of the cabinet 10, thus eliminating the rod member 139 and plate 141.

The cam blocks 125, 127, 129 and 131 are secured to the back wall 10F of the cabinet 10 by means of brackets 143, 145, 147 and 149, respectively. The brackets 143, 145, 147 and 149 enables the respective cam blocks 125, 127, 129 and 131 to slide up and down along the axis B—B without allowing for rotational movement perpendicular to the axis B—B, except that block member 149 does not slide along the axis B—B. As shown in FIGS. 9 and 10, extending from the back of drawer 13 is an extension 151 which cooperates with the cam member 123 as hereinafter described in detail. Drawer 11 has an extension 153 which cooperates with cam member 121 in a similar manner as extension 151 cooperates with cam member 123.

A spring 155 is mounted on rod member 135 between a plate 157 secured to the rod member 135 and the cup 137. The plate 157 is preferably secured to rod 135 by weld 159 although any suitable securing means is contemplated by the scope of the present invention. The opening 137A in cup 137 is in a slideable relationship with the rod member 135. Spring 155 urges the rod members 133 and 135, cam blocks 125, 127 and 129 and cam members 121 and 123 downward to urge the interlock assembly 120 into a closed drawer position (FIG. 7). The upper end 135A of rod member 135 moves towards the top wall 10A as stop means for the interlock assembly 120 when a drawer 11 or 12 is opened, as shown in FIG. 8. End 135A of rod member 135 need not engage the top wall 10A, but only needs to move close enough to the top wall 10A to prevent the opening of a second drawer.

FIG. 8 shows a pivot member 161 of cam member 123 which is rotated clockwise by extension 151 by pulling drawer 13 open. Cam member 121 has a similar extension (not shown) which is rotated clockwise by the extension 153 of drawer 11 when drawer 11 is pulled open. FIGS. 9 and 10 show the rotation of the pivot member 161 when drawer 13 opens. The pivot member 161 rides in a arcuately shaped slot 163 on cam surface 163A of extension 151 of the drawer 13.

As can be seen in FIG. 8, cam member 123 is rotated when extension 151 engages pivot member 161, causing cam member 123 to move 60° in an arc perpendicular to the axis B—B. This causes lobes 123A of cam member 123 to engage indentations 129B and 131B of lobes 129A and 131A on cam blocks 129 and 131 in a similar manner as described with respect to cam member 23 and cam blocks 29 and 31 in FIGS. 3 and 6. This causes the train of blocks 125, 127 and 129, the rod members 133 and 135 and cam member 121 to move in an upward direction so that the upper end 135A of rod 135 moves towards the top wall 10A of cabinet 10 to provide a stop. The upper end 135A of rod 135 need not engage the top wall 10A, but only needs to move close enough to the top wall 10A to prevent a second drawer from being opened. Spring 155 is compressed by the upward movement of the train. When the cam member 123 is rotated about the axis B—B, a stop tip 165 extending from the cam member 123, adjacent to the pivot member 151 is moved adjacent to the guide bracket 147. The stop tip 165 prevents the cam member 123 from rotating too far around the axis B—B. A similar stop tip (not shown) is provided on cam member 121.

When the drawer 13 is closed, the cam member 123 is rotated by pivot member 161, and spring 155 urges the train of the interlock assembly 120 downward along the axis B—B so that the lobes 29A and 31A of block members 29 and 31 are in the valleys 23B of cam member 23, as shown in FIG. 7. This also causes the lobes 123A of cam member 123 to be positioned in the valleys (not shown) of the block members 129 and 131, thus allowing another drawer 11 or the same drawer 13 to be opened. The stop mechanism shown in FIGS. 7 and 8 can also be adapted to the interlock assembly 20 shown in FIGS. 2 and 3.

FIG. 11 shows another preferred embodiment of the engagement means for the interlock assembly 120 which includes a rod 135B extending upwards along the axis C—C from member 25 (block member 25 is not shown in FIG. 6) to a first cup member 167 which is in a slideable relationship with a second member cup 169 mounted on the top wall 10A of cabinet 10. The slideable cups 167 and 169 are held in a closed door position (FIG. 11) by a spring 171 mounted between the cups 167 and 169.

Rod 135B is secured to a bottom plate 167A of cup 167 by a weld 173. Extending upwards from the bottom plate 167A is an annular sleeve 167B which is mounted radially inside of an annular sleeve 169A for cup 169. The second cup 169 is secured to the top wall 10A of cabinet 10 by a weld 175.

Opening one of the drawers 11 or 13 causes that drawers respective cam member 121 or 123 to rotate with respect to the cam blocks 125 and 127 or 129 and 131 as has been previously described. This causes rod 135B to move upwards along the axis C—C. Upward movement of rod 135B causes cup 167 to slide with respect to cup 169 and move towards the upper wall 10A of cabinet 10 to provide a stop means for the interlock assembly 120. Cup 169 does not need to contact wall 10A, but only needs to move close enough to the wall 10A to prevent the opening of a second drawer. When the opened drawer is closed, the spring 171 urges the cup 167 down along the axis C—C, away from the top wall 10B and into the closed drawer position (FIG. 11) so that another drawer or the same drawer can be opened. The stop mechanism shown in FIG. 11 can also be adapted to the interlock assembly shown in FIGS. 2 and 3.

It will be appreciated that the rod members 133 and 135 with the cam members 121 and 123, and the block members 125, 127, 129 and 131 can be positioned as a train at an angle to the vertical between the drawers 11 and 13 where the drawers 11 and 13 are positioned one above the other. The file drawers 11 and 13 can also be side-by-side rather than one above the other with the interlock assembly 120 in a horizontal position.

It is intended that the foregoing description be only illustrative of the present invention and that the present invention be limited only by the hereinafter appended claims.

We claim:

1. In a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back wall to close the drawer with an interlock assembly mounted inside of and on the housing which engages an arm means from the drawer to prevent both drawers from being opened simultaneously, the improvement which comprises:

(a) a plurality of cam means each of the cam means rotatably mounted around a longitudinal axis defined by each of the cam means and adjacent to each of the drawers, wherein the cam means have opposed ends along the longitudinal axis defined by the cam means with at least one of the ends of each of the cam means having a sinusoidal surface around the longitudinal axis defined by the cam means such that there are lobes of the sinusoidal surface and valleys between the lobes on the sinusoidal surface on each cam means;

(b) block means mounted on the cam means along the longitudinal axis defined by the cam means and mating with the cam means at the one end of each of the cam means having the sinusoidal surface, the block means having mating ends comprising second sinusoidal surfaces with lobes and valleys offset around the end of the block means when the drawers are closed such that the lobes and the valleys of the cam means and the block means mate together, wherein a pin means is mounted only between the cam means and the block means which allows for movement of the cam means relative to the block means along and around the longitudinal axis defined by the cam means;

(c) pivotal means mounted on a side between the ends of each cam means, which engage the arm means for each drawer;

(d) rigid connection means vertically oriented along the longitudinal axis defined by the cam means and mounted on and extending between block means for adjacent drawers and mounted on and extending between block means and the housing; and (e) guide means mounted inside the housing and supporting the block means for linear movement along the longitudinal axis defined by the cam means without rotational movement around the longitudinal axis defined by the cam means upon rotation of the cam means by the pivot means and by the arm means, wherein the guide means supports the interlock assembly to prevent movement of the connection means, cam means and block means perpendicular to the longitudinal axis defined by the cam means and wherein when one of the cam means is rotated around the longitudinal axis defined by the cam means on the pin means relative to the block means by the pivot means and by the arm means of a first one of the drawers, the lobes of the one cam means and the block means of the first drawer are engaged in a manner which causes the block means to move along the longitudinal axis defined by the cam means and the cam means to rotate on the pin means and to move along the longitudinal axis defined by the cam means with the connection means such that the interlock assembly moves towards an abutment means on the housing such that a second cam means is prevented from being rotated by the pivot means and by the arm means of a second one of the drawers to prevent the second drawer from being opened.

2. In a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back wall to close the drawer with an interlock assembly mounted inside of and on the housing which engages an arm means from the drawer to prevent both drawers from being opened simultaneously, the improvement which comprises:

(a) a plurality of cam means each of the cam means rotatably mounted around a longitudinal axis defined by each of the cam means and adjacent to each of the drawers wherein opposite ends of the cam means have a sinusoidal surface around the longitudinal axis defined by the cam means such that there are lobes of the sinusoidal surface and valleys between the lobes on the surface at each end of each cam means;

(b) block means mounted on the cam means along the longitudinal axis defined by the cam means and mating with the cam means at each of the ends of each cam means, the block means having ends with second sinusoidal surfaces with lobes and valleys offset around the ends of the block means such that when the drawers are closed, the lobes and valleys of the cam means and the block means mate together, wherein a pin means is mounted between the cam means and the block means which allows for movement of the cam means relative to the block means along and around the longitudinal axis defined by the cam means;

(c) pivot means mounted on a side between the ends of each cam means which engage the arm means for each drawer;

(d) rigid connection means vertically oriented along the longitudinal axis defined by the cam means and mounted on and extending between block means for adjacent drawers and mounted on and extending between block means and the housing; and (e) guide means mounted inside the housing and supporting the block means for linear movement along the longitudinal axis defined by the cam means without rotational movement around the longitudinal axis defined by the cam means upon rotation of one of the cam means by the pivot means and by the arm means, wherein the guide means supports the interlock assembly to prevent movement of the connection means, cam means and block means perpendicular to the longitudinal axis defined by the cam means and wherein when one of the cam means is rotated around the longitudinal axis defined by the cam means on the pin means relative to the block means by the pivot means and by the arm means of a first one of the drawers, the lobes of the one cam means and the block means of the first drawer are engaged in a manner which causes the block means to move along the longitudinal axis defined by the cam means and the cam means to rotate on the pin means and to move along the longitudinal axis defined by the cam means with the connection means, such that a stop means portion of the interlock assembly prevents a second cam means from being rotated by the pivot means and by the arm means of a second one of the drawers to prevent the second drawer from being opened.

3. The apparatus of claim 2 wherein the pin means mounted between the cam means and the block means is provided by an opening in the cam means along the longitudinal axis defined by the cam means, and a mating pin extending along the longitudinal axis defined by the cam means from the end of the block means having the second sinusoidal surface.

4. The apparatus of claim 2 wherein a resilient means is provided on the interlock assembly to urge the block means and the cam means together in a closed drawer position.

5. The apparatus of claim 4 wherein the resilient means that urges the block means and the cam means together in the closed drawer position is a coil spring means.

6. The apparatus of claim 2 wherein the connection means are rod means that a re vertically oriented along the longitudinal axis defined by the cam means and mounted on and extending between block means for adjacent drawers and mounted on and extending between block means and the housing.

7. The apparatus of claim 2 wherein the connection means are mounted with opposed ends of the connection means extending between block means of adjacent drawers and between block means and the top wall and the bottom wall of the housing; and wherein the stop means is comprised of an engagement means provided at an end of one of the connection means mounted between the block means and an abutment means on the housing, wherein the engagement means moves toward the abutment means to provide the stop means when one of the drawers is open, thereby preventing the opening of another drawer.

8. The apparatus of claim 7 wherein the engagement means is a support means which supports a coil spring means around and along the longitudinal axis defined by the cam means between abutment means on the housing and the support means so as to urge the interlock assembly into a closed drawer position and wherein when one of the drawers is open so that the interlock assembly is moved along the longitudinal axis defined by the cam means by the one cam means, the support means is moved towards the abutment means on the housing to provide the stop means for the interlock assembly, thereby preventing the opening of another drawer.

9. The apparatus of claim 8 wherein a sleeve means depends from one wall of the housing as the abutment means, along and radially outside of a portion of the support means and in a closely spaced relationship to position the engagement means along the longitudinal axis defined by the cam means when the drawers are in the closed drawer and open drawer positions.

10. The apparatus of claim 9 wherein the engagement means comprises a journal means mounted on the abutment means on the housing with an opening in the journal means, spaced from the abutment means along the longitudinal axis defined by the cam means and wherein the end of the one connection means is mounted between the block means and the abutment means on the housing and extends through the opening in the journal means with a coil spring means mounted on the one connection means between a disc means and the journal means wherein the end of the one connection means is spaced from the abutment means when the interlock assembly is in the closed drawer position and wherein when one of the drawers is open so that the interlock assembly is moved along the longitudinal axis defined by the cam means by the one cam means, the end of the one connection means is moved towards the abutment means on the housing to provide the stop means for the interlock assembly, thereby preventing the opening of another drawer.

11. The apparatus of claim 2 wherein one of the ends of a first block means, opposite end with the second sinusoidal surfaces, has an opening along the axis that provides for mounting a first connection means extending from the first block means to an end of the first connection means mounted through an opening in a first abutment means on the housing with a resilient means mounted on the first connection means between the first block means and the first abutment means, which resilient means urges the block means and the cam means of the interlock assembly together in a closed drawer position and wherein one of the ends of a second block means, opposite the end with the second sinusoidal surfaces, has an opening along the longitudinal axis defined by the cam means that provides for mounting a second connection means extending from the second block means to an end of the second connection means mounted to a second abutment means on the housing and wherein the first and second connection means and the first and second abutment means help position the interlock assembly along the longitudinal axis defined by the cam means when the drawers are in the closed drawer and open drawer positions.

12. The apparatus of claim 11 wherein the stop means which prevents the second drawer from being opened when the first drawer is in the open drawer position, is comprised of the first abutment means on the housing, with the opening in the first abutment means positioned along the longitudinal axis defined by the cam means and wherein the end of the first connection means extends through the opening in the first abutment means with the resilient means mounted on the first abutment means so that when the one cam means is rotated around the longitudinal axis defined by the cam means by the pivot means and by the arm means of the first drawer, the lobes of the one cam means and of the block means of the first drawer are caused to engage so that the end of the first connection means moves along the longitudinal axis defined by the cam means in the opening in the first abutment means, and the guide means enables the interlock assembly to move linearly along the longitudinal axis defined by the cam means with the first block means moving along the longitudinal axis defined by the cam means towards the abutment means to provide the stop means to prevent the second drawer from being opened.

13. The apparatus of claim 12 wherein the first abutment means is a bracket means mounted adjacent to the first block means, and wherein when the first drawer is in the open drawer position, the first block means moves to a closely spaced relationship to the bracket means so that the second drawer is prevented from being opened.

14. The apparatus of claim 2 wherein the lobes and valleys of the sinusoidal surfaces at each end of the cam means are in a similar circumferential position opposite each other around the longitudinal axis defined by the cam means.

15. The apparatus of claim 2 wherein the lobes of the sinusoidal surfaces of either the block means or in the cam means have recesses which act as detents to hold the lobes of the block means or the cam means not having the recesses in engagement when the drawers are open and which release upon closing of the drawer.

16. The apparatus of claim 2 wherein the lobes and valleys are phased 120° apart around the longitudinal axis defined by the cam means on the cam means and the block means.

17. The apparatus of claim 2 wherein the cam means and the block means are composed of a rigid, plastic material.

18. The apparatus of claim 2 wherein the rigid, plastic material is selected from the group consisting of a nylon and an acetyl resin.

19. The apparatus of claim 2 wherein the cam means are mounted adjacent to a side portion of each of the drawers.

20. In a cabinet apparatus including a housing having a top wall and opposed bottom wall, two opposed sidewalls, a front wall and back wall, at least two drawers mounted inside the housing through the front wall so as to slide horizontally away from the front wall to open the drawer and towards the back wall to close the drawer with an interlock assembly mounted inside of and on the housing which engages an arm means from the drawer to prevent both drawers from being opened simultaneously, the improvement which comprises:

(a) a plurality of cam means each of the cam means rotatably mounted around a longitudinal axis defined by each of the cam means and adjacent to each of the drawers, wherein opposite ends of the cam means have a sinusoidal surface around the longitudinal axis defined by the cam means such that there are lobes of the sinusoidal surface and valleys between the lobes on the surface at each end of each cam means;

(b) block means mounted on the cam means along the axis and mating with the cam means at each of the ends of each cam means, the block means having ends with second sinusoidal surfaces with lobes and valleys offset around the ends of the block means such that when the drawers are closed, the lobes and valleys of the cam means and the block means mate together, wherein the block means have at least one tab means extending from at least one side of the block means;

(c) pivot means mounted on a side between the ends of each cam means which engage the arm means for each drawer;

(d) rigid connection means vertically oriented along the longitudinal axis defined by the cam means and mounted on and extending between block means for adjacent drawers and mounted on and extending between block means and the housing; and (e) guide means mounted inside the housing and supporting the block means for linear movement along the longitudinal axis defined by the cam means without rotational movement around the longitudinal axis defined by the cam means upon rotation of one of the cam means by the pivot means upon rotation of one of the cam means by the pivot means and by the arm means, wherein a portion of the guide means is mounted on the tab means of the block means such that the guide means supports the interlock assembly to prevent movement of the connections means, cam means and block means perpendicular to the longitudinal axis defined by the cam means and wherein when one of the cam means is rotated around the longitudinal axis defined by the cam means by the pivot means and by the arm means of a first one of the drawers, the lobes of the one cam means and the block means of the first drawer are engaged in a manner which causes the block means, the cam means and the connection means of the interlock assembly to move linearly along the guide means along the longitudinal axis defined by the cam means such that a stop means portion of the interlock assembly prevents a second cam means from being rotated by the pivot means and by the arm means of a second one of the drawers to prevent the second drawer from being opened.

21. The apparatus of claim 20 wherein the guide means has a J-shaped cross-section perpendicular to the longitudinal axis defined by the cam means and wherein the block means have a rectangular cross-section perpendicular to the longitudinal axis defined by the cam means with a front side and opposed back side, two opposed lateral sides and two opposed ends between the lateral sides wherein one of the ends of the block means provides for the sinusoidal surfaces with the tab means providing at least one of the lateral sides and mounted on the guide means so that the interlock assembly moves along the longitudinal axis defined by the cam means when the one cam means is rotated about the longitudinal axis defined by the cam means by the pivot means and by the arm means of the first drawer.

22. The apparatus 21 wherein the guide means is mounted on one of the side walls of the housing.

23. The apparatus of claim 22 wherein the guide means extends over the back side and around the opposed lateral sides and at least a portion of the front side of the block means to lock the block means on the guide means.

24. The apparatus of claim 23 wherein the cam means are provided with a tip means mounted on the side between the ends of each of the cam means adjacent to the pivot means, wherein when the one cam means is rotated about the longitudinal axis defined by the cam means by the pivot means and by the arm means of the first drawer, the tip means is rotated around the longitudinal axis defined by the cam means to a position adjacent the guide means to prevent the lobes of the one cam means and the block means of the first drawer from rotating around the longitudinal axis defined by the cam means past the engagement between the lobes of the one cam means and the block means when the first drawer is in the open position.

25. The apparatus of claim 20 wherein the connection means are mounted with opposed ends of the connection means extending between block means of adjacent drawers and between block means and the top wall and the bottom wall of the housing; and wherein the stop means is comprised of an engagement means provided at an end of one of the connection means mounted between the block means and an abutment means on the housing, wherein the engagement means moves towards the abutment means to provide the stop means when one of the drawers is open, thereby preventing the opening of another drawer.

26. The apparatus of claim 20 wherein one of the ends of a first block means opposite the end with the second sinusoidal surfaces has an opening along the longitudinal axis defined by the cam means that provides for mounting a first connection means extending from the first block means to an end of the first connection means mounted through an opening in a first abutment means on the housing with a resilient means mounted on the first connection means between the first block means and the first abutment means, which resilient means urges the block means and the cam means of the interlock assembly together in a closed drawer position and wherein one of the ends of a second block means, opposite the end with the second sinusoidal surfaces, has an opening along the longitudinal axis defined by the cam means that provides for mounting a second connection means extending from the second block means to an end of the second connection means mounted to a second abutment means on the housing and wherein the first and second connection means and the first and second abutment means along with the guide means keep the interlock assembly positioned along the longitudinal axis defined by the cam means when the drawers are in the closed drawer and open drawer positions.

27. The apparatus of claim 26 wherein the stop means, which prevents the second drawer from being opened when the first drawer is in the open drawer position, is compared of the first abutment means on the housing with the opening in the first abutment means positioned along the longitudinal axis defined by the cam means and wherein the end of the first connection means extends through the opening in the first abutment means with the resilient means mounted on the first connection means between the first block means and the first abutment means so that when the one cam means is rotated around the longitudinal axis defined by the cam means by the pivot means and by the are means of the first drawer, the lobes of the one cam means and of the block means of the first drawer are caused to engage so that the end of the first connection means moves along the longitudinal axis defined by the cam means in the opening in the first abutment means and the guide means enables the interlock assembly to move linearly along the longitudinal axis with the first block means moving along the longitudinal axis defined by the cam means towards the abutment means to provide the stop means to prevent the second drawer from being opened.

28. The apparatus of claim 26 wherein the resilient means that urges the block means and the cam means together in the closed drawer position is a coil spring means.

29. The apparatus of claim 20 wherein the lobes and valleys of the sinusoidal surfaces at each end of the cam means are in a similar circumferential position opposite each other around the longitudinal axis defined by the cam means.

30. The apparatus of claim 20 wherein the lobes of the sinusoidal surfaces of either the block means or the cam means have recesses which act as detents to hold the lobes of the block means or the cam means not having the recesses in engagement when the drawers are open and which release upon closing of the drawer.

31. The apparatus of claim 20 wherein the connection means are rod means vertically mounted along the longitudinal axis and mounted on and extending between block means for adjacent drawers and mounted on and extending between block means and the housing.

32. The apparatus of claim 20 wherein the lobes and valleys are phased 120° apart around the longitudinal axis defined by the cam means on the cam means and the block means.

33. The apparatus of claim 26 wherein the cam means and the block means are composed of a rigid, plastic material.

34. The apparatus of claim 20 wherein the cam means are mounted adjacent to a side portion of each of the drawers.

* * * * *

UNITED STATES PATENT AND TRADEMARK OFFICE

CERTIFICATE OF CORRECTION

PATENT NO. : 5,335,986

DATED : August 9, 1994

INVENTOR(S) : Laude E. Hartrum, et. al.

It is certified that error appears in the above-indentified patent and that said Letters Patent is hereby corrected as shown below:

Column 6, line 19, "casket" should be --cabinet--.
Column 9, line 8, "The Interlock. assembly" should read --The interlock assembly--.
Column 11, line 52, "pivotal" should be --pivot--.
Column 14, line 3, Claim 10, "Claim 9" should be --Claim 7--.
Column 15, line 14, Claim 15, after "or", "in" should be deleted.
Column 16, line 45, Claim 22, after "apparatus" and before "21",--of Claim-- should be inserted.
Column 17, line 38, Claim 27, "compared" should be --comprised--.
Column 18, line 33, Claim 27, "are means" should be --arm means--.

Signed and Sealed this

Twenty-second Day of November, 1994

*Attest:*

Bruce Lehman

BRUCE LEHMAN

*Attesting Officer*

*Commissioner of Patents and Trademarks*